US008540216B2

(12) United States Patent
Abeleda et al.

(10) Patent No.: US 8,540,216 B2
(45) Date of Patent: Sep. 24, 2013

(54) CARPET STRETCHING APPARATUS

(76) Inventors: Benjamin P. Abeleda, Virginia Beach, VA (US); Earl T. Hackley, Norfolk, VA (US)

( * ) Notice: Subject to any disclaimer, the term of this patent is extended or adjusted under 35 U.S.C. 154(b) by 266 days.

(21) Appl. No.: 12/928,150

(22) Filed: Dec. 6, 2010

(65) Prior Publication Data

US 2012/0138880 A1 Jun. 7, 2012

(51) Int. Cl.
*B65H 77/00* (2006.01)

(52) U.S. Cl.
USPC ..... 254/201; 294/8.6

(58) Field of Classification Search
USPC ..... 254/201–212; 294/8.6
See application file for complete search history.

(56) References Cited

U.S. PATENT DOCUMENTS

| | | | | | |
|---|---|---|---|---|---|
| 3,001,762 | A | * | 9/1961 | Skolnick | 254/212 |
| 3,572,800 | A | | 3/1971 | Graziano | |
| 3,617,082 | A | | 11/1971 | Sparks | |
| 3,784,078 | A | | 1/1974 | Escoe | |
| 3,945,609 | A | | 3/1976 | Platek | |
| 4,008,879 | A | | 2/1977 | Youngman | |
| 4,084,787 | A | * | 4/1978 | Kowalczyk | 254/201 |
| 4,361,311 | A | * | 11/1982 | Koroyasu et al. | 254/200 |
| 4,627,653 | A | | 12/1986 | Koroyasu | |
| 5,145,225 | A | | 9/1992 | Muller et al. | |
| 5,228,660 | A | * | 7/1993 | Massicotte | 254/201 |
| 5,456,794 | A | * | 10/1995 | Barrett | 156/763 |
| 5,472,170 | A | * | 12/1995 | Anasson | 254/212 |
| 5,607,141 | A | | 3/1997 | Clark | |
| 5,855,361 | A | * | 1/1999 | Krowchak | 254/209 |
| 6,113,075 | A | * | 9/2000 | McMichael et al. | 254/203 |
| 6,371,446 | B1 | | 4/2002 | Gauthier | |
| 6,613,188 | B1 | * | 9/2003 | Berg et al. | 156/717 |
| 6,669,173 | B1 | * | 12/2003 | Dunn | 254/201 |
| 6,669,174 | B1 | * | 12/2003 | Vita | 254/212 |
| 7,140,597 | B2 | * | 11/2006 | Chien | 254/201 |
| 7,159,850 | B2 | | 1/2007 | Peters | |
| 7,175,161 | B2 | * | 2/2007 | Hochmeyer et al. | 254/201 |
| 7,384,498 | B2 | * | 6/2008 | Rannikko | 156/701 |
| 7,451,961 | B2 | * | 11/2008 | Kirker et al. | 254/209 |
| 7,758,022 | B1 | * | 7/2010 | Wright et al. | 254/201 |
| 8,251,117 | B2 | * | 8/2012 | Kron et al. | 156/762 |
| 2004/0069980 | A1 | * | 4/2004 | Shannon | 254/202 |
| 2006/0180799 | A1 | * | 8/2006 | Rannikko | 254/202 |
| 2008/0217594 | A1 | * | 9/2008 | Kirker et al. | 254/212 |
| 2009/0127524 | A1 | | 5/2009 | Stenhouse | |

* cited by examiner

*Primary Examiner* — Emmanuel M Marcelo
(74) *Attorney, Agent, or Firm* — William G. Sykes

(57) ABSTRACT

An electrically or pneumatically powered carpet stretcher including a wheeled dolly and designed for use by a standing operator. A variable speed electric or pneumatically powered drive unit having a chuck is removably attached to the wheeled dolly. A number of interchangeable head assemblies may be selectively attached to a power unit using its chuck. A multi-head carpet stretching head assembly allows fast stretching of carpet. Smaller single unit heads allow work in corners or other tight spaces. A tile removing head may also be provided to utilize the carpet stretcher to remove tile from floors or other similar tasks. An adjustable height lip may be provided at the front edge of a carpet stretching head to allow easy tucking of carpets with different piles and/or thicknesses.

15 Claims, 6 Drawing Sheets

CARPET STRETCHING APPARATUS

FIELD OF THE INVENTION

The invention pertains to carpet stretching apparatus and, more particularly, to an electrically or pneumatically powered carpet stretcher supported on a dolly and designed for use by a standing operator. The carpet stretcher has interchangeable carpet stretching and other heads.

BACKGROUND OF THE INVENTION

The installation of wall-to-wall carpeting is a well known craft wherein once a carpet is loose laid over a floor it is stretched to cause peripheral edges to be retained by a tack strip or the like. The stretching process ensures that there or no bubbles or bulges where the carpet is not lying tightly against the surface of the floor being covered.

In the prior art, carpet is stretched by a tradesman, typically positioned on his or her knees using a kick tool or similar apparatus to move the carpet perimeter toward a wall or other demarcation where the carpet backing is hooked and retained by a tack strip or other similar device. The kick tool is often powered by the tradesman striking his or her knee against a rearward facing surface of the tool. Needles to say, this posture and operation is hard on the back and knees of the tradesman as the physical position makes using proper body mechanics difficult.

DISCUSSION OF THE RELATED ART

Several Unites States patents have attempted to improve the traditional process for installing carpet of the prior art.

For example, U.S. Pat. No. 3,572,800 for PNEUMATIC CARPET KICKER issued Mar. 30, 1971 to Anthony J. Graziano teaches a carpet kicker tool using a pneumatic cylinder as a shock absorber to cushion the blow of a user's knee against an impact surface 12 adapted to receive a force from a user's knee.

U.S. Pat. No. 3,784,078 for CARPET STRETCHER AND KICKER issued Jan. 8, 1974 to James L. Escoe shows a carpet stretching apparatus having an adjustable length, elongated handle that is lodged against an opposing wall and then a carpet gripping head may be advanced to stretch the carpet. A built-in staple gun may be used to affix the stretched carpet to an underlying surface.

U.S. Pat. No. 3,945,609 for DUAL ACTION CARPET STRETCHER issued Mar. 23, 1976 to Stanley F. Platek discloses a carpet stretcher for drawing two segments of carpet together to close a gap therebetween.

U.S. Pat. No. 4,627,653 for CARPET STRETCHER issued Dec. 9, 1986 to Arata Koroyasu teaches a carpet stretcher using a knee actuated pneumatic mechanism for stretching carpet.

U.S. Pat. No. 5,607,141 for EXTENDABLE SUPPORT ARM FOR A CARPET STRETCHER issued Mar. 4, 1997 to James F. Clark provides an extension for attachment to a conventional carpet kicker.

U.S. Pat. No. 6,371,446 for HAND-HELD PNEUMATIC CARPET STRETCHER issued Apr. 16, 2002 to Kenneth C. Gauthier et al. discloses a hand-help, pneumatically actuated carpet stretcher.

U.S. Pat. No. 6,669,174 for KNEELESS KICKING TOOL FOR STRETCHING A CARPET issued Dec. 30, 2003 to Christopher L. Vita provides a carpet stretching apparatus wherein a pneumatically actuated ram is used to advance a carpet gripping head.

U.S. Pat. No. 7,140,597 for CARPET STRETCHING DEVICE issued Nov. 28, 2006 to Hsin-Feng Chien teaches a pneumatically actuated carpet stretching device utilizing an external source of compressed air.

U.S. Pat. No. 7,159,850 for PNEUMATIC CARPET STRETCHER issued Jan. 9, 2007 to Lee Peters teaches yet another pneumatically actuated carpet stretching device utilizing an external source of compressed air.

U.S. Pat. No. 7,175,161 for POWER CARPET KICKER issued Feb. 13, 2007 to Michael A. Hochmeyer et al. provides another pneumatically powered, hand held carpet kicker.

Published United States Patent Application No. 2009/0127524 for CARPET STRETCHER published May 21, 2009 upon application by Reginald N. Stenhouse disclose a hand held, hand actuated carpet stretcher utilizing a slide hammer.

None of the patents and published patent application, taken singly, or in any combination are seen to teach or suggest the novel carpet stretching apparatus of the present invention.

SUMMARY OF THE INVENTION

In accordance with the present invention there is provided an electrically or pneumatically powered carpet stretcher including a wheeled dolly and designed for use by a standing operator. A variable speed electric or pneumatically powered drive unit having a chuck is removably attached to the wheeled dolly. A number of interchangeable head assemblies may be selectively attached to a power unit by means of the chuck. A multi-head carpet stretching head assembly allows fast stretching of carpet. Smaller single unit heads allow work in corners or other tight spaces. A head assembly for removing tile from floors or other similar tasks is also provided. An adjustable height lip may be provided at the front edge of a carpet stretching head to allow easy tucking of carpets with different piles and/or thicknesses.

It is, therefore, an object of the invention to provide a powered carpet stretching apparatus operable from a standing position.

It is another object of the invention to provide a powered carpet stretching apparatus having readily interchangeable head assemblies, each selected for a particular carpet stretching or other related task.

It is an additional object of the invention to provide a powered carpet stretching apparatus that is collapsible for ease of storage and transportation.

It is a further object of the invention to provide a powered carpet stretching apparatus that utilizes a hammer jack apparatus having a chuck to actuate a selected, interchangeable head assembly.

It is a still further object of the invention to provide a powered carpet stretching apparatus that utilizes a variable speed hammer jack apparatus.

It is yet another object of the invention to provide a powered carpet stretching apparatus wherein carpet stretching heads of an interchangeable head assembly are individually replaceable.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides wheeled carpet stretching apparatus for use by a standing operator. The unit allows the operator to perform carpet stretching and similar activates (e.g., floor tile removal) using good body mechanics. Further, the elimination of the need for knee driven carpet kickers can prevents knee and back injuries well known to those who have installed carpet using such devices over a prolonged period of time.

Figure 1A:
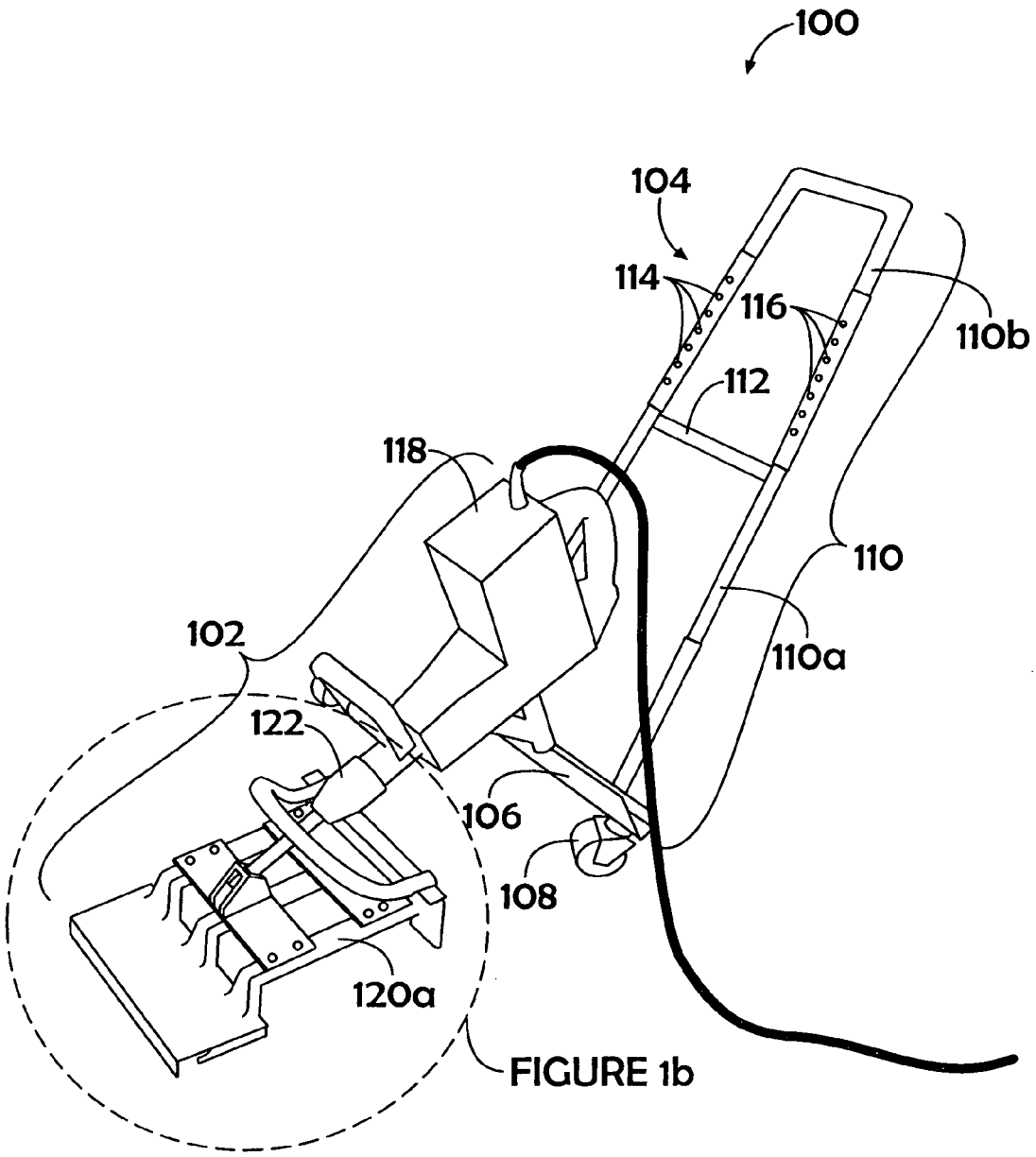
FIG. 1*a* is a front perspective view of the carpet stretcher in accordance with the present invention.
Figure 1B:
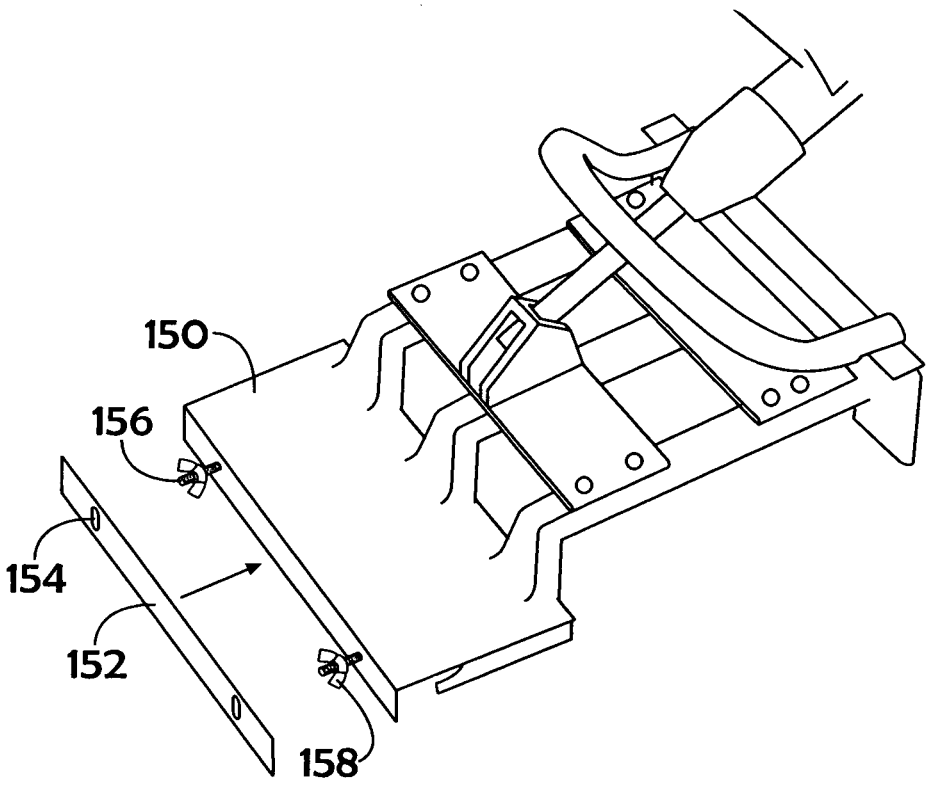
FIG. 1*b* is a detailed view an interchangeable head assembly of FIG. 1*a,*

Referring first to FIGS. 1*a* and 1*b*, there are shown a front perspective view of a carpet stretcher in accordance with the present invention, generally at reference number 100, and a detailed front perspective view of an interchangeable head portion of the carper stretcher 100 of FIG. 1*a*, respectively.

The carpet stretching mechanism 102 is supported on a carriage 104. Carriage 104 has a horizontal member 106 having swivel wheels or casters 108 at both a proximal and distal end thereof. Wheels or casters 108 are disposed to swivel with respect to horizontal member 106. It will be recognized that many different type and/or sizes of wheels or casters 108 may be utilized for the application. For extreme maneuverability, conical or spherical structures such as that shown in U.S. Pat. No. 4,058,344 for GROUND ENGAGING MEMBER FOR MOVABLE STRUCTURES issued Nov. 15, 1977 to James Dyson. Consequently, the invention is not considered limited to any specific size or shape of wheel or caster. Rather the invention includes any suitable type, style, or shape of wheel or caster.

An adjustable length handle 110 is attached to horizontal member 106. Handle 110 has a lower section 110*a* and an upper section 110*b* that is adjustably, slidably received within lower section 110*a*. A plurality of holes 114 in each of lower section 110*a* and upper section 110*b* allow the overall length of handle 110 to be adjusted in discrete increments depending on the inter-hole spacing, not specifically identified, of plurality of holes 114. Fastening means 116 secures lower section 110*a* to upper section 110*b*. Fastening means 116 may be a spring type D clip, a pin and cotter pin arrangement. It is believed that such fastening arrangements are well known to those of skill in the art and are not further described herein. It will further be recognized that any other type of fastening system suitable for securing lower section 110*a* to upper section 110*b* my be substituted for the spring typed D clip chosen for purposes of disclosure. Consequently, the invention is not considered limited to the particular fastener arrangement chosen for purposes of disclosure. Rather, the invention is intended to include any alternate, suitable fastening arrangement or system.

Typically, a brace 112 is secured between right and left members, not specifically identified, of lower handle section 110*a*.

Carpet stretching mechanism 102 is removably affixed to horizontal member 106 of carriage 104. Carpet stretching mechanism 102 consists of a drive unit 118 and an interchangeable head assembly 120*a*.

Figure 2A:
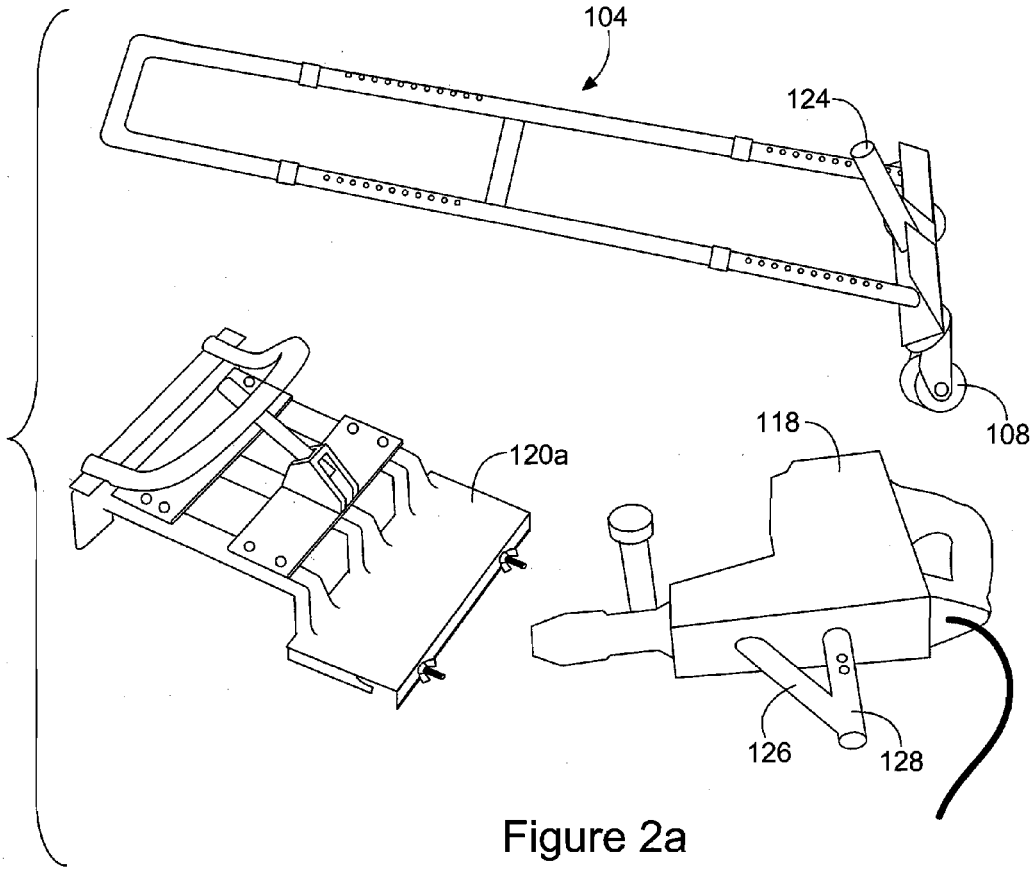
FIG. 2*a* is a perspective view of the components of the carpet stretcher of FIGURE la in a disassembled state.
Figure 2B:
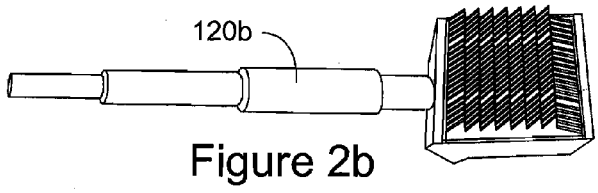
FIG. 2*b* is a perspective view of second interchangeable head assembly.
Figure 2C:
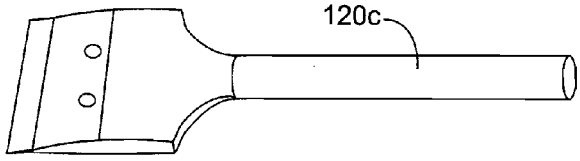
FIG. 2*c* is a perspective view of third interchangeable head assembly.

Drive unit 118 as typically an electrically or pneumatically powered, variable speed hammer jack unit removably secured to horizontal member 106 with a major axis thereof aligned at a predetermined angle with respect to a horizontal surface upon which carper stretcher 100 is resting. Drive unit 118 is mounted to horizontal member 106 such that a chuck 122 is facing forward. As may best be seen in FIG. 2*a*, drive unit 118 has a mounting bracket 126 affixed to a bottom surface, not specifically identified, thereof. Mounting bracket 126 includes a hollow tube 128 designed to slip over mounting column 124 affixed to horizontal member 106 of carriage 104. FIGS. 2*b* and 2*c* show perspective views of two alternate interchangeable head assemblies 120*b* and 120*c*, respectively.

A Chicago Electric Power Tools Industrial 2 HP demolition hammer sold as Catalog Number 93853 has been found suitable for the application. It will be recognized that numerous suitable alternate drive units may be known to those of skill in the art. Any such drive unit may therefore be substituted for the Chicago Electric Power Tools unit chosen for purposes of disclosure.

An interchangeable head assembly 120*a* is removably connected to drive unit 118 by chuck 122.

Carpet stretcher 100 is designed as a readily disassembleable unit for ease of storage and transportation. Referring now also to FIG. 2, there is shown a perspective view of the components of carpet stretcher 100 in a disassembled arrangement. Three different interchangeable head assemblies 120*a*, 120*b*, 120*c*, are also shown. Such head assemblies 120*a*, 120*b*, 120*c* are each described in more detail hereinbelow.

Figure 3A:
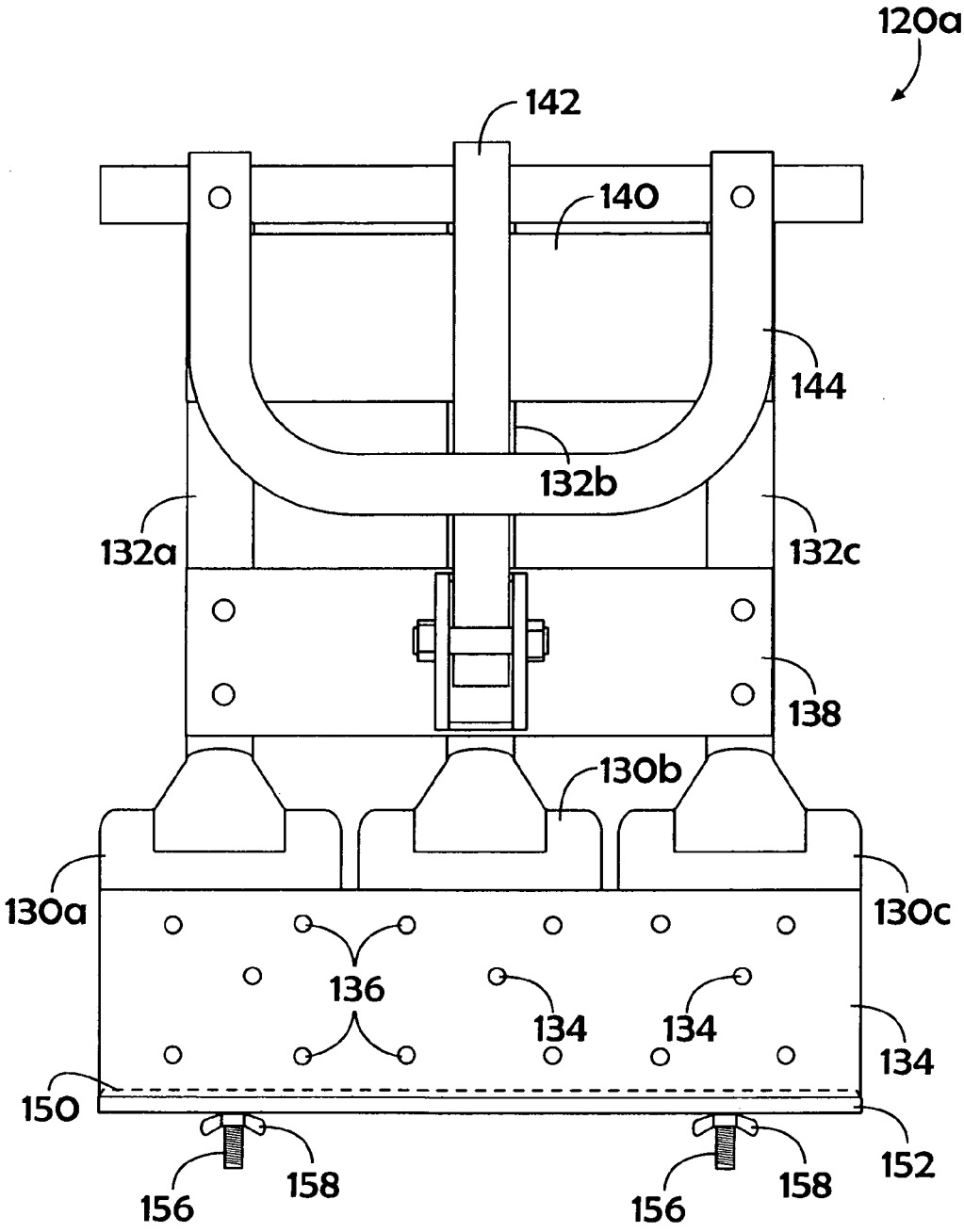
FIGS. 3*a* and 3*b* are top plan and bottom plan views, respectively of a first embodiment of an interchangeable head assembly for use with the carpet stretcher of FIGURE 1*a;*
Figure 3B:
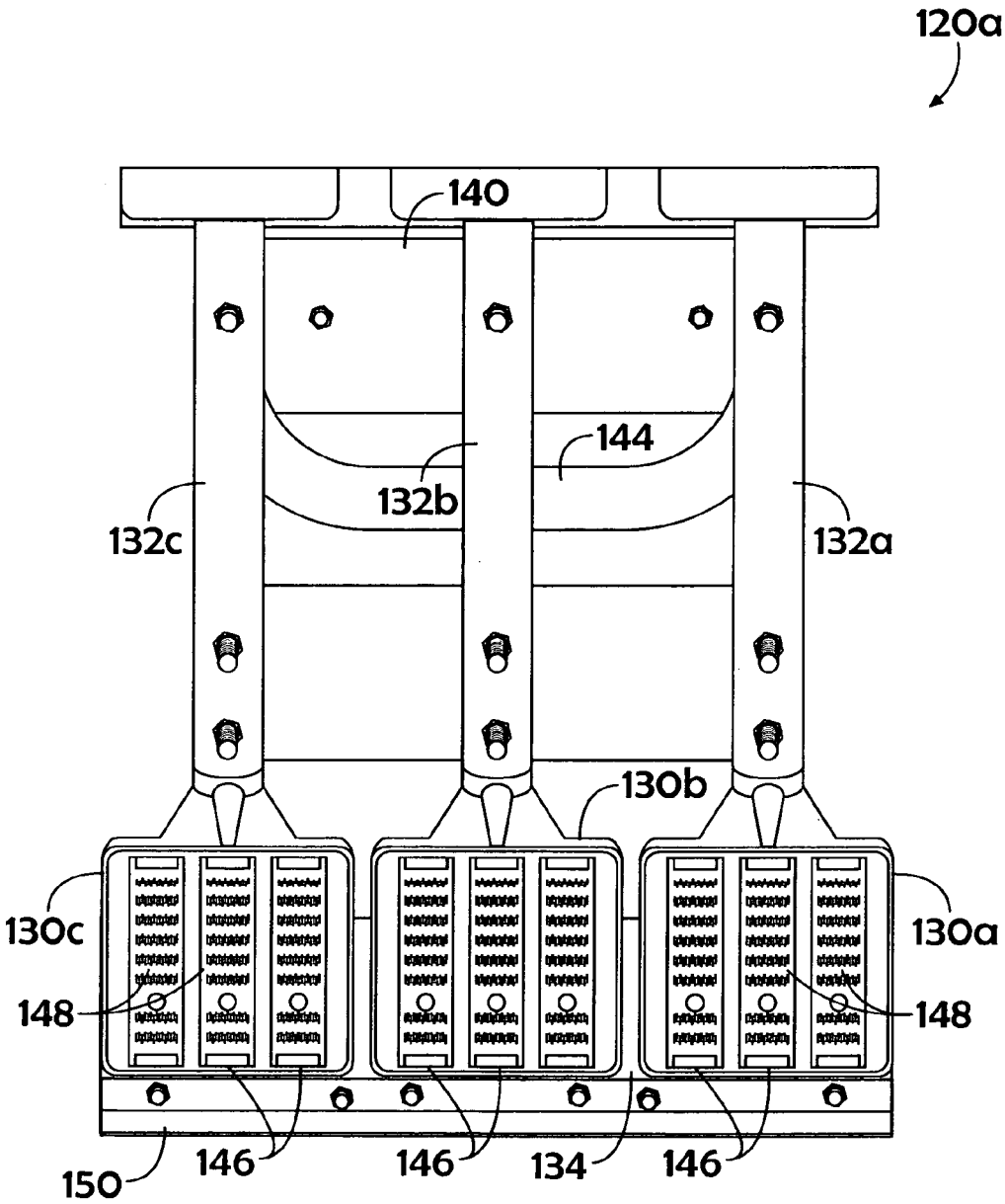

Referring now also to FIGS. 3*a* and 3*b*, there are shown top and bottom plan views, respectively of a first embodiment of an interchangeable head assembly 120*a*. Interchangeable head assembly 120*a* is a three-head carpet stretching interchangeable head assembly.

Carpet kickers are believed to be well known to those of skill in the art. Carpet kickers typically have a head that has carpet engaging projections disposed on a bottom surface thereof. The geometry of such carpet engaging projection may vary considerably from head to head. The exact carpet engaging projections may be selected according the nap of the particular carpet being installed as well as the personal preference of the installer. As carpet kicker heads are well known, they are not further discussed herein. It will be recognized that geometry of carpet engaging projections may be selected for use in interchangeable head assemblies 120*a*, 120*b*, 120*c*, of the invention. Consequently, the invention is not considered limited to a particular style, size, or pattern of carpet engaging projections. Rather, the invention includes any and all sizes, shapes, geometries, and arrangements of carpet engaging projections.

A typical commercially available carper stretcher is a carpet knee kicker Model No. 10-501 manufactured by Roberts Floor Covering Installation Products, A division of Q.E.P. of Boca Raton, Fla., USA. Available replacement parts for the Roberts 10-501 include a head and tube assembly, Catalog No. 10-501-02A; a base plate assembly, Model No. 10-501-07A; nail grip inserts Model No. 10-501-03; and pin cover Catalog No. 10-501-08. The carpet heads 130*a*, 130*b*, 130*c*, etc. may be formed from components similar to the Roberts replacement parts enumerated hereinabove.

Interchangeable head assembly 120*a* has three heads 130*a*, 130*b*, 130*c*, each having a head shell, not specifically identified, and each being attached to a proximal end of a respective support shaft 132*a*, 132*b*, 132*c*. Heads 130*a*, 130*b*, 130*c* are each removably attached to a head support member 134 by screws 136.

Middle regions of support shafts 132*a*, 132*b*, 132*c* are each attached to a second support member 138.

Distal ends of support shafts 132*a*, 132*b*, 132*c* are each attached to rear support member 140.

A connection shaft 142 has a proximal end attached to second support member 138 and a distal end adapted for removable attachment to chuck 122 of drive unit 118.

A shaft support brace 144 connects connection shaft 142 to a rear support member 140.

Each head 130*a*, 130*b*, 130*c* has a lower surface having carpet engaging projections 146 protruding outwardly therefrom. As discussed hereinabove, carpet engaging projections may have a variety of sizes, shapes and patterns. In the example chosen for purposes of disclosure, each head 130*a*, 130*b*, 130*c* each has three removable carpet engaging projection bearing strips 148.

Head support member 134 has an L-shaped front member 150 at its front edge. A "kicker" strip 152 adjustably attached to L-shaped front member 150. Kicker strip 152 typically has elongated slots 154 that allow it adjustment along a axis perpendicular to the horizontal surface upon which carpet or the like is being installed. Threaded studs 156 (e.g., bolts) forwardly protruding from L-shaped member 150 pass through elongated slots 154. Kicker strip 152 is maintained in a desired vertical position against L-shaped member 150 by wing nuts 158. It will be recognized that many alternate devices and/or methods for adjustable securing kicker strip 152 to L-shaped member 150 will be known to those of skill in the art, any of which may be substituted for the combination of studs 156, vertical slots 154 and wing nuts 158. Consequently, the invention is not considered to the studs 156, vertical slots 154, and wing nuts 158 chosen for purposes of disclosure. Rather the invention is intended to include any suitable alternative thereto. Such vertical adjustability allows for tucking carpets of varying pile height.

While a three-head interchangeable head assembly 120*a* has been chosen for purposes of disclosure, it will be recognized that multiple head interchangeable head assemblies may be constructed by extending the concepts of three head interchangeable head assembly 120*a*. Consequently, the invention is not considered limited to the three head interchangeable head assembly chosen for purposes of disclosure. Rather, the invention includes interchangeable head assemblies having any practical number of heads. Five head and seven head assemblies would allow stretching broad widths of carpet. Even wider interchangeable head assemblies may be constructed to meet a particular operating circumstance or environment.

Figure 4:
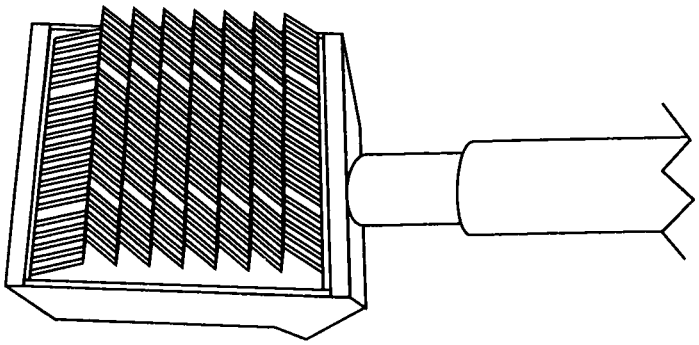
FIG. 4 is a bottom plan view another embodiment of a carpet stretching head assembly having only a single carpet stretching head.
Figure 5:
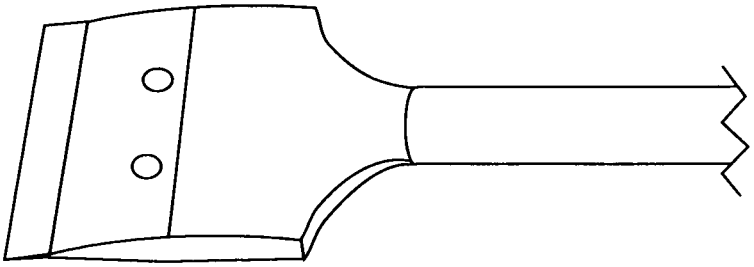
FIG. 5 is top plan view of an interchangeable head assembly having a floor tile removing blade.

Referring now also to FIG. 4, there is shown a bottom plan view another embodiment of a carpet stretching head assembly having only a single carpet stretching head.

Referring now also to FIG. 6, there is shown top plan view of an interchangeable head assembly having a floor tile removal blade.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A carpet stretching apparatus for use by a standing operator; comprising:

a) a carriage assembly having at least two ground-engaging casters swivelably connected thereto;

b) a drive unit removably attached to said carriage, said drive unit comprising a variable speed hammer jack selected from the group: an electrically powered, motorized variable speed hammer jack, and a pneumatically powered variable speed hammer jack;

c) a chuck connected to said variable speed hammer jack selected from the group: an electrically powered, motorized variable speed hammer jack, and a pneumatically powered variable speed hammer jack and adapted to receive an interchangeable head assembly therein; and d) an interchangeable head assembly operably connected to said drive unit through said chuck.

2. The carpet stretching apparatus for use by a standing operator as recited in claim 1, wherein said carriage comprises an adjustable length handle.

3. The carpet stretching apparatus for use by a standing operator as recited in claim 1, wherein said interchangeable head assembly comprises at least one selected from the group: a carpet stretching head, and a floor tile removal blade.

4. The carpet stretching apparatus for use by a standing operator as recited in claim 3, wherein said interchangeable head assembly comprises a carpet stretching head comprising:

i) a head shell; and ii) a plurality of downwardly directed, carpet engaging protrusions disposed within said head shell.

5. The carpet stretching apparatus for use by a standing operator as recited in claim 4, further comprising:

iii) a lip adjustably disposed on a front edge of said head shell, said lip being adjustable in a place orthogonal to a horizontal surface upon which said carpet stretcher is disposed and parallel to a front edge of said interchangeable head assembly.

6. The carpet stretching apparatus for use by a standing operator as recited in claim 5, wherein said interchangeable head assembly comprises at least two carpet stretching heads.

7. The carpet stretching apparatus for use by a standing operator as recited in claim 5, wherein said plurality of downwardly directed, carpet engaging protrusions comprise a removable support plate.

8. The carpet stretching apparatus for use by a standing operator as recited in claim 7, wherein said removable support plate comprises a nail plate.

9. The carpet stretching apparatus for use by a standing operator as recited in claim 7, wherein said removable support plate comprises at least two removable support plates.

10. The carpet stretching apparatus for use by a standing operator as recited in claim 9, wherein said interchangeable head assembly comprises at least two carpet stretching heads.

11. The carpet stretching apparatus for use by a standing operator as recited in claim 4, wherein said interchangeable head assembly comprises at least two carpet stretching heads.

12. The carpet stretching apparatus for use by a standing operator as recited in claim 4, wherein said plurality of downwardly directed, carpet engaging protrusions comprise a removable support plate.

13. The carpet stretching apparatus for use by a standing operator as recited in claim 12, wherein said removable support plate comprises a nail plate.

14. The carpet stretching apparatus for use by a standing operator as recited in claim 12, wherein said removable support plate comprises at least two removable support plates.

15. The carpet stretching apparatus for use by a standing operator as recited in claim 14, wherein said interchangeable head assembly comprises at least two carpet stretching heads.

* * * * *